US007574961B2

(12) United States Patent
Barezzani et al.

(10) Patent No.: US 7,574,961 B2
(45) Date of Patent: Aug. 18, 2009

(54) DEVICE FOR THE APPLICATION AND/OR REMOVAL OF RAIL CLIPS

(75) Inventors: Gualtiero Barezzani, Concesio (IT); Cesare Braga, Brescia (IT)

(73) Assignee: Cembre S.p.A., Brescia (IT)

( * ) Notice: Subject to any disclaimer, the term of this patent is extended or adjusted under 35 U.S.C. 154(b) by 230 days.

(21) Appl. No.: 10/588,896

(22) PCT Filed: Mar. 16, 2004

(86) PCT No.: PCT/IT2004/000125

§ 371 (c)(1),
(2), (4) Date: Mar. 2, 2007

(87) PCT Pub. No.: WO2005/088013

PCT Pub. Date: Sep. 22, 2005

(65) Prior Publication Data

US 2007/0157844 A1 Jul. 12, 2007

(51) Int. Cl.
*E01B 29/24* (2006.01)
*E01B 29/05* (2006.01)

(52) U.S. Cl. ..... 104/17.2; 104/2

(58) Field of Classification Search ..... 104/16, 104/17.1, 17.2

See application file for complete search history.

(56) References Cited

U.S. PATENT DOCUMENTS 4,068,593 A * 1/1978 Leeves ..... 104/307
5,074,219 A * 12/1991 Theurer et al. ..... 104/17.2
5,191,838 A * 3/1993 Hansen ..... 104/2
5,438,931 A * 8/1995 Becker et al. ..... 104/17.2
5,584,247 A * 12/1996 Almaraz et al. ..... 104/2
5,586,502 A * 12/1996 Weber ..... 104/17.2
5,730,060 A * 3/1998 Straub et al. ..... 104/17.2
5,839,377 A * 11/1998 Brenny et al. ..... 104/17.2
6,138,573 A * 10/2000 Brenny et al. ..... 104/17.2
2007/0157844 A1 * 7/2007 Barezzani et al. ..... 104/2

FOREIGN PATENT DOCUMENTS

GB 2 333 115 7/1999
JP 2000-038704 2/2000

* cited by examiner

*Primary Examiner*—S. Joseph Morano
*Assistant Examiner*—Jason C Smith
(74) *Attorney, Agent, or Firm*—Dickstein Shapiro LLP

(57) ABSTRACT

A device (1) for the application and/or for the removal of elements for the connection of a rail to a railway track sleeper, comprising at least one lever (2, 3) mounted on a frame (4) in a rotatable manner around an axis of rotation (5, 6), and equipped with at least one pressure organ (7, 8) adapted to engaging the connecting element, and at least one cylinder-piston group (9) adapted to driving the lever (2, 3) in order to assemble or disassemble the connecting element. The cylinder-piston group (9) comprises a cylinder body (10) and a sliding piston (11) housed within the cylinder body (10) and moveable with respect to the cylinder body (10) under the action of pressurised fluid. At least one first (12, 14) and second (13, 15) stop surfaces interact in such a manner as to form a stop device (16, 17) for stopping the lever (2, 3) in a defined position with respect to the frame (4), wherein the stop surfaces are formed, the one (12, 14) on the piston (11) and the other (13, 15) on the cylinder body (10) of said cylinder-piston group (9).

23 Claims, 3 Drawing Sheets

25
32
35
30
33
40
27
28
29
12
31
34
39
33
36
38
40

41
37
39
41
34
36
40

11
23
10
26
29
28
25
27
32
35
30

10
20
14
19
21
11
22
18
17

DEVICE FOR THE APPLICATION AND/OR REMOVAL OF RAIL CLIPS

A device for the application and/or for the removal of elements (so-called clips or fast-clips) for the connection of a rail to a railway track sleeper forms the subject of the present invention.

A cylinder-piston group for the aforesaid device for the application and/or for the removal of connecting elements of a rail to a railway track sleeper forms a further subject of the present invention.

Devices are known for the assembly and the disassembly of elements for the connection of a rail to a sleeper, for example for fast clip type connecting elements, which are applied in a substantially perpendicular direction to the longitudinal direction of the rail and may assume the following three positions, relevant for assembly:

An inserted position, wherein a base part of the clip is completely inserted into a shoulder connected to the sleeper and a pressure section of the clip rests on the foot profile of the rail connecting the latter to the sleeper. The inserted position is the position where the clip is closest to the rail.

A parking position, where the base part of the clip still engages the shoulder connected with the sleeper, but the clip is withdrawn from the rail to a point wherein the pressure section of the clip no longer rests on the foot profile of the rail. -An extracted position, where the base part of the clip still just engages the shoulder connected with the sleeper, but the clip is withdrawn from the rail to a point wherein the pressure section of the clip is well separated from the foot profile of the rail. The extracted position is the position where the clip is furthest away from the rail.

Precise positioning of the connecting elements during their assembly and/or disassembly is crucial for the quality of the rail-sleeper connection, since the forces required for the insertion and extraction of the connecting elements are so large that any inaccuracy in positioning would result in the damage or the destruction of the synthetic isolators placed between the shoulder, clip and rail. For this reason, the clip manufacturers specify defined distances between the clip and the isolator, both in the inserted position and in the parking position.

Known devices typically comprise two opposing levers, mounted on a frame so as to be able to rotate around respective axes of rotation, wherein each lever is equipped with at least one pressure organ adapted to engaging a connecting element, and the levers are movable through at least one hydraulic cylinder-piston group. With the aim of ensuring precise positioning of the connecting element during the assembly or disassembly operation, the provision of a stop member is known, placed in the motion trajectory of the lever and adapted to forming a limit stop.

This solution, despite ensuring the precise positioning of the levers and, hence, the connecting elements during their assembly/disassembly, has the drawback that the thrust of the hydraulic cylinder-piston group against the rigid stop member is transmitted through the levers and their connection to the frame, which are subjected to very high stresses which result in the need for the upsizing of such components.

The aim of the present invention is thus that of providing a device for the application and/or for the removal of elements (so-called clips or fast-clips) for the connection of a rail to a railway track sleeper, having such characteristics as to obviate the drawbacks cited with reference to the prior art.

Such aim is achieved by a device according to claim 1 and by a cylinder-piston group according to claim 24.

In order to better understand the invention and to appreciate the advantages, an embodiment will be described in the following, by way of non-limiting example, making reference to the enclosed figures, wherein.

Figure 1:
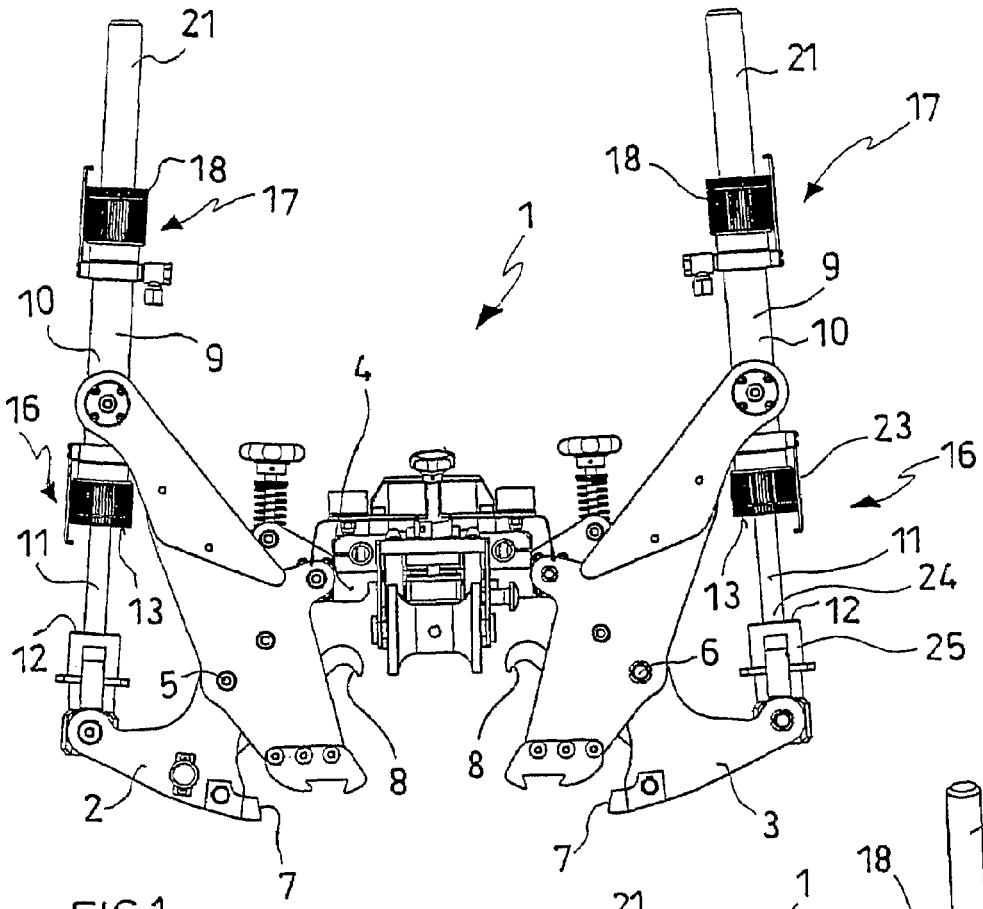
FIG. 1 is a front view of the device according to the invention.
Figure 2:
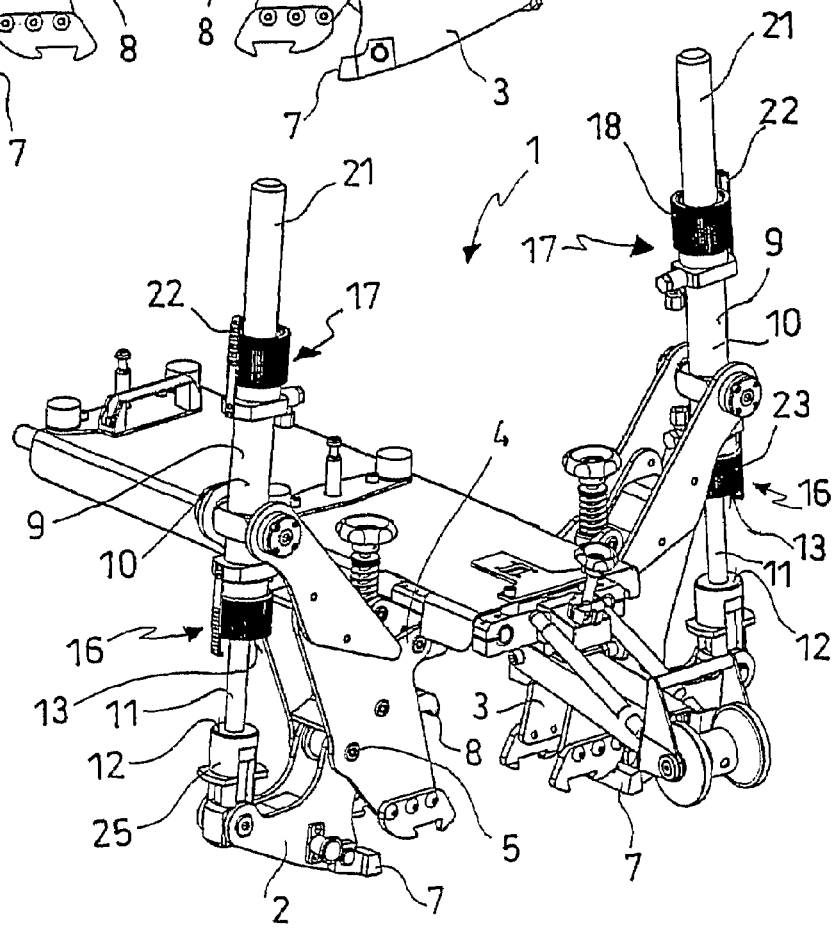
FIG. 2 is a perspective view of the device in FIG. 1.

With reference to FIGS. 1 and 2, a device for the application and/or for the removal of elements (clips or fast clips) for the connection of a rail to a railway track sleeper is generally indicated with the reference numeral 1.

The device 1 comprises at least one lever 2, 3 mounted on a frame 4 so as to be able to rotate around an axis of rotation 5, 6 and equipped with at least one pressure organ 7, 8 adapted to engaging the connecting element (not shown).

The pressure organs preferably comprise a pressure shoulder 7 for the insertion and a hook 8 for the extraction of the connecting element (clip).

A cylinder-piston group 9 adapted to driving the lever 2, 3 in order to assemble or disassemble the connecting element is inserted between the frame 4 and the lever 2, 3 and comprises a cylinder body 10 and a piston 11 slidingly housed within the cylinder body 10 and movable with respect to the cylinder body 10 under the action of the pressurised fluid (not shown).

The device 1 comprises at least a first 12, 14 and a second 13, 15 stop surface which interact in such a way as to form a stop device 16, 17 for stopping the lever 2, 3 in a defined position with respect to the frame 4. Said stop surfaces 12, 13, 14, 15 are associated, the one 13, 15 with the cylinder body 10 and the other 12, 14 with the piston 11 of the cylinder-piston group 9.

In accordance with one embodiment, the device 1 comprises two opposing levers 2, 3, mounted on two sides of the frame 4 in such a way as to rotate around respective axes 5, 6 and movable through two cylinder-piston groups 9, one for each lever 2, 3. The cylinder body 10 is connected, preferably rotatably, to the frame 4 and the piston 11 is connected, preferably rotatably, with the corresponding lever 2, 3.

Alternatively, a single cylinder-piston group 9 may be provided, connected for example to both levers 2, 3 (not shown in the figures).

FIGS. 3 to 8 show an embodiment of the cylinder-piston group 9, wherein two stop devices 16 and 17 are provided.

A first stop device 16 is adapted to limiting the movement of the piston 11 in a first direction, thus defining a withdrawn limit position thereof, wherein the lever 2, 3 rests, for example, in a position corresponding to the clip parking position or extracted position.

A second stop device 17 is adapted to limiting the movement of the piston 11 in a second direction, opposite to the first direction, thus defining a protracted limit position thereof, wherein the lever 2, 3 rests for example in a position corresponding to the inserted clip position. In accordance with one embodiment, the first stop device 16 comprises an adjusting ring nut 23 screwed onto the cylinder body 10 and equipped with a second stop surface 13.

On a first end 24 of the piston 11 is connected or formed a stop member 25 equipped with a first stop surface 12. The stop surfaces 12 and 13 are configured in such a way as to abut against one another in the withdrawn position of the piston 11 thus impeding any further movement thereof in the first direction.

The retracted position of the piston 11 and therefore the corresponding limit-stop position of the lever 2, 3 corresponding to the extracted position or to the parking position of the clip is adjustable by the rotation of the adjusting ring nut 23 which results in the displacement of the second stop surface 13 in the longitudinal direction of the cylinder body 10.

The pitch of the adjusting ring nut 23 threading defines the fineness of the adjustment.

Figure 4:
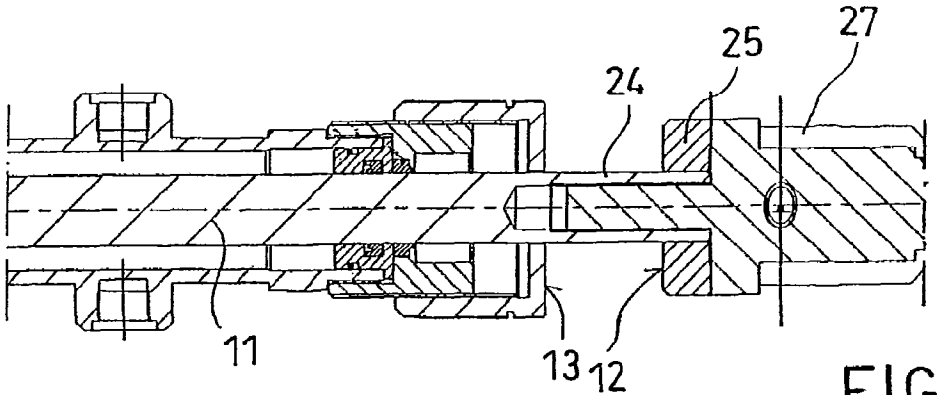
FIG. 4 is a cross-sectional view of a detail of the piston-cylinder group in FIG. 3.

According to the embodiment shown for instance in FIG. 4, the stop member 25 projects radially from a portion of the piston 11 extending outside the cylinder body 10.

A graduated plate 23, integral with the cylinder body 10, is located at the adjusting ring nut 23. This graduated plate 26 preferably comprises a millimetric scale allowing the precise positioning of the adjusting ring nut 23, i.e. of its second stop surface 13.

One particularly advantageous embodiment provides that the stop member 25 or rather its first stop surface 12 is moveable by sliding along the piston 11 and positionable in at least two different positions, thus providing coarse adjusting means or, in other words, means of rapid changeover or switching between the two withdrawn positions of the piston 11 and, hence, between two limit-stop positions of the lever 2, 3, corresponding for example to the extracted position and to the parking position of the connecting element.

Advantageously, the stop member 25 comprises a tubular body 27 inserted over the piston 11 or onto a stem connected thereto. The tubular body 27 has a, preferably cylindrical, side wall 28 and a front wall 29 which forms the first stop surface 12 facing towards the second stop surface 13 of the adjusting ring nut 23.

In a rear wall 30 of the tubular body 27, opposite the front wall 29, is formed at least a first support surface 31 and a second support surface 32, wherein the distance in the longitudinal direction of the piston 11 or rather of the stop member 25 between the first support surface 31 and the first stop surface 12 is less than the distance between the second support surface 32 and the first stop surface 12.

Said support surfaces 31, 32 are adapted to leaning against at least one bearing surface 33 formed for example on a bearing block 36 of the piston 11 or of a stem connected thereto.

Figures 6, 7A, 7B, 8:
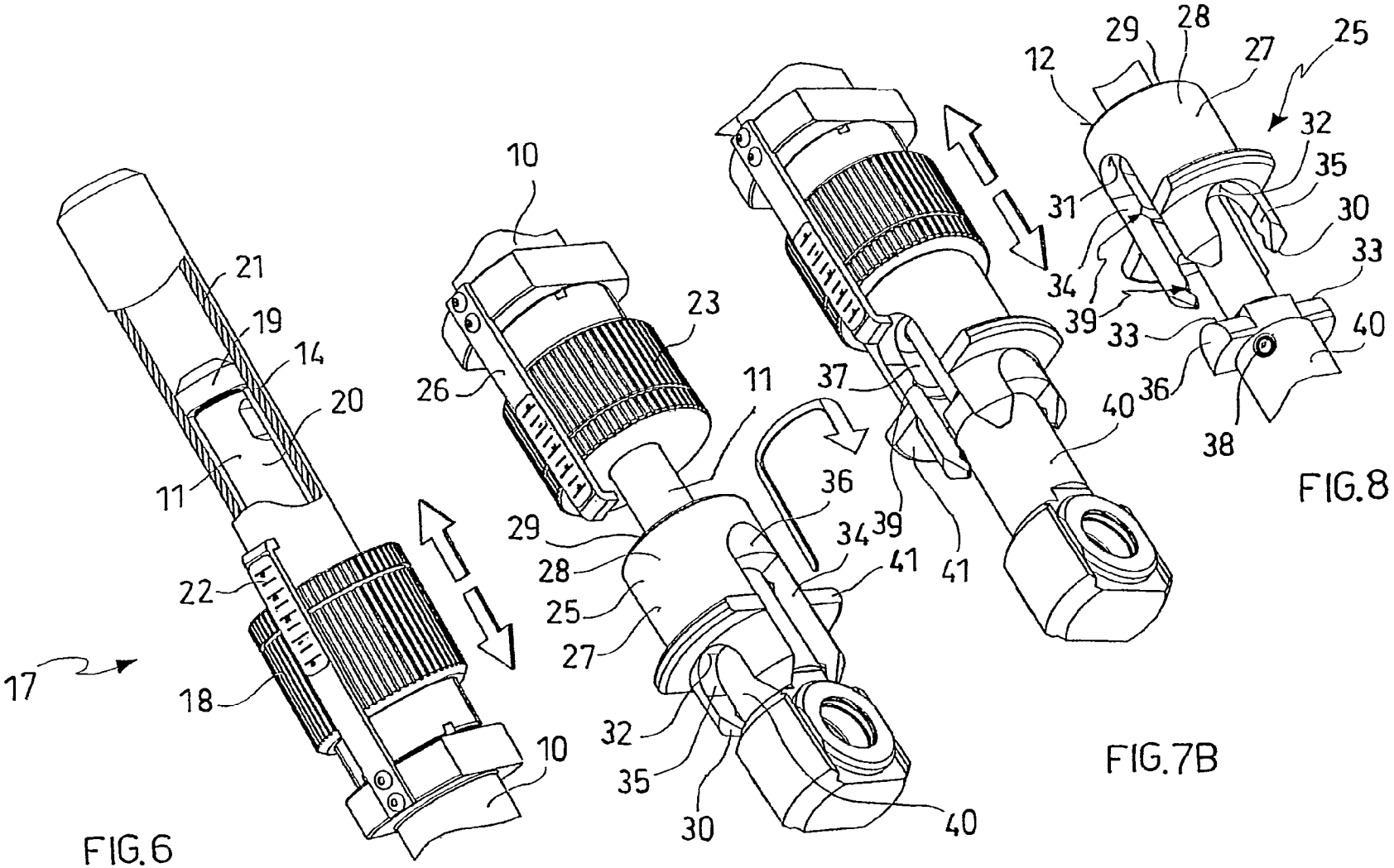
FIG. 6 is a perspective view, in partial cross section, of a detail of the piston-cylinder group in FIG. 3.
FIGS. 7A and 7B show a detail of the cylinder-piston group in two modes of use.
FIG. 8 is a perspective view of a further detail of the cylinder-piston group of FIG. 3.

In accordance with the embodiment reported in FIG. 8, in the rear wall 30 of the stop member 25 is formed at least one first groove 34 which forms the first support surface 31 and a second groove 35, deeper than the first groove 34, which forms the second support surface 32.

The first and second grooves 34, 35 are distant from one another in the circumferential direction of the stop member 25 and adapted to receiving the aforesaid bearing block 36. Advantageously, the stop member 25 comprises two first grooves 34 which are opposing or, in other words out of phase by 180°, and two second opposing grooves 35 out of phase by 90 degrees with respect to the first grooves 34. The bearing block 36 projects radially from two opposite sides of the piston 11 or from a stem connected thereto, in such a way as to engage, through its two bearing surfaces 33 respectively, either the first support surfaces 31 in the two first grooves 34 or the second support surfaces 32 in the two second grooves 35.

The rapid changeover between two withdrawn positions of the piston 11 (or, in other words, from the extracted position to the parking position) occurs therefore through the following sequence of movements of the stop member 25 (cf. FIGS. 7A and 7B):

- the translation or displacement of the stop member 25 towards the adjusting ring nut 23 up to the point whereby the bearing block 36 leaves the first grooves 34;
- the rotation of the stop member 25 by 90° until the point whereby the bearing block 36 is aligned with the second grooves 35;
- the translation or displacement of the stop member 25 away from the adjusting ring nut 23 up to the point whereby the bearing surfaces 33 of the bearing block 36 rest against the second support surfaces 32 within the second grooves 35.

The rapid changeover from the parking position to the extracted position occurs in an analogous manner.

Advantageously, blocking means are provided for locking the stop member 25, preferably elastically, in its changeover positions.

According to one embodiment, the piston 11 or a stem connected thereto comprises a resiliently supported stop dowel 38, projecting from the outer surface of the piston 11 or stem and adapted to elastically engaging respectively one of two circumferential channels 39 formed in the inner surface 37 of the stop member 25, when the latter stops in one of its changeover positions. Alternatively, the stop dowel may be associated with the stop member 25 and the channels with the piston 11 or with a stem connected thereto.

In accordance with one embodiment, the bearing block 6 and the stop dowel 38 are formed in a separate stem 40, connectable with its first end to the piston 11 and with its second end to the lever 2, 3.

Advantageously, the stop member 25 has grasping means for enabling easy manual changeover, for example a substantially radial shoulder 41.

In accordance with one embodiment, the second stop device 17 also comprises an adjusting ring nut 18 screwed onto the cylinder body 10 and equipped with a second stop surface 15, as well as a mushroom-shaped section 19 placed at a second end 20 of the piston 11, opposite the first end 24, and equipped with a first stop surface 14. The stop surfaces 14 and 15 are configured in such a way as to abut against one another in the protracted position of the piston 11 thus impeding any further movement thereof in the second direction.

The protracted position of the piston 11 and therefore the corresponding limit-stop position of the lever 2, 3 corresponding to the inserted position of the clip, is adjustable by the rotation of the adjusting ring nut 18 which results in the displacement of the second stop surface 15 in the longitudinal direction of the cylinder body 10.

The pitch of the adjusting ring nut 18 threading defines the fineness of the adjustment.

Advantageously, a hollow cover 21 is fixed to the adjusting ring nut 18 and adapted to housing and protecting the second end 20 of the piston 11 with the mushroom-shaped section 19.

Figure 5:
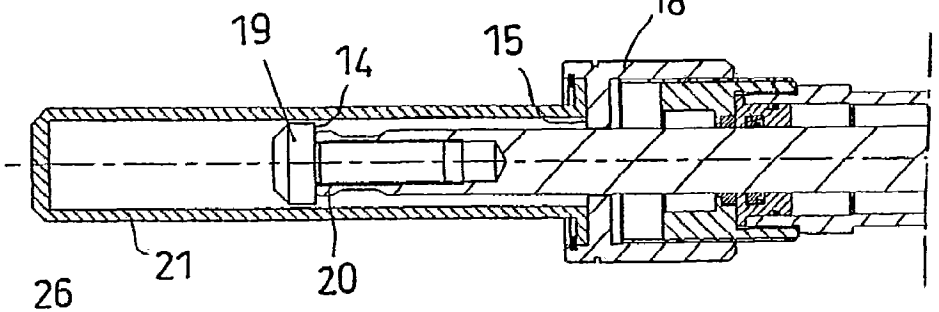
FIG. 5 is a cross-sectional view of a further detail of the piston-cylinder group in FIG. 3.
Figure 3:
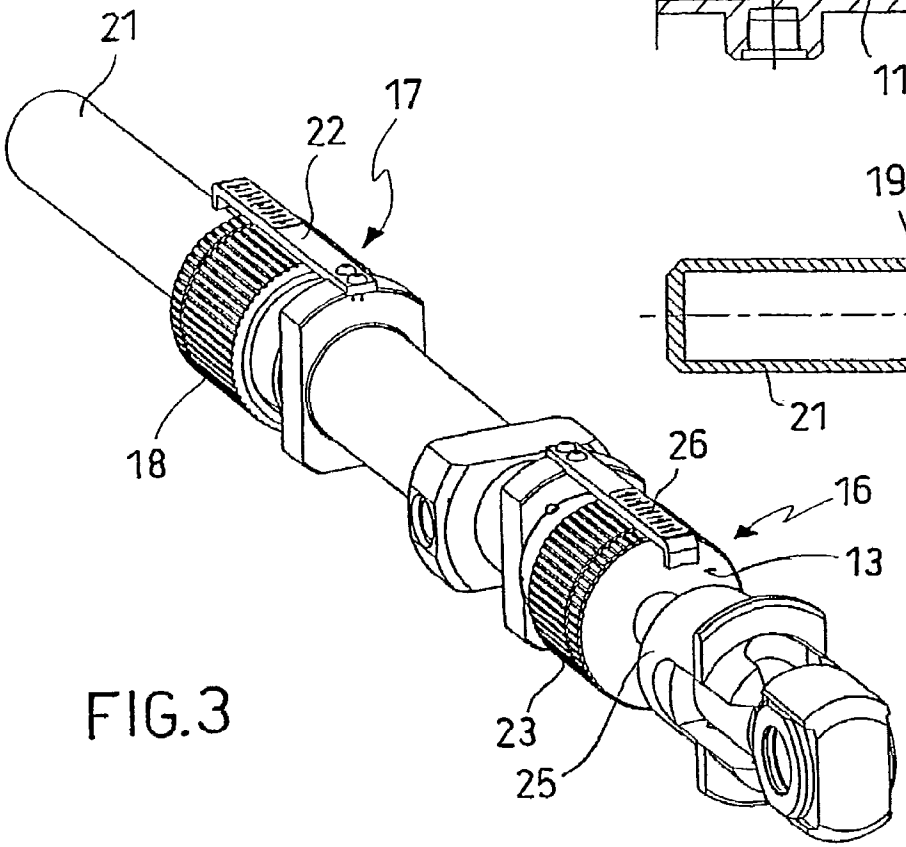
FIG. 3 is a perspective view of a piston-cylinder group of the device in FIG. 1.

According to the embodiment shown for instance in FIG. 5, the mushroom-shaped section 19 is formed by a screw screwed into a hole in the second end 20 of the piston 11.

A graduated plate 22, integral with the cylinder body 10, is located at the adjusting ring nut 18. Such graduated plate preferably comprises a millimetric scale and allows the precise positioning of the adjusting ring nut 18, or rather of its second stop surface 15.

The device 1 and the cylinder-piston group 9 according to the present invention have a number of advantages.

They allow the precise positioning of the levers 2, 3 in their limit-stop positions, thus avoiding any stresses on the levers and on their connection with the frame by the reaction force necessary in order to stop the cylinder in its protracted and withdrawn limit positions.

Thanks to the adjusting ring nuts, the device is easily and precisely adaptable to rails with different connecting elements.

Furthermore, thanks to the rapid changeover means, the device 1 may be quickly changed over between different working modes, for example the extraction of the connecting elements (clips, fast-clips) up to a parking position or up to a complete extraction position, without the need for covering large adjustment distances using the fine adjustment ring nut.

The rapid changeover means, positioned within the seatings formed by the support surfaces 32, allow restricting the movement of the pistons 11 and hence reducing the cycle time in the insertion and extraction operations in the clips parking position. In the case where the rapid changeover means are positioned within the seating formed by the support surfaces 31, these allow the attainment of the complete extraction of the clip, an operation which requires greater movement.

Obviously, to the device for the application and/or removal of rail clips, as well as the cylinder-piston group according to the present invention, a skilled person faced with the problem of satisfying contingent and specific requirements, might bring about further modifications and variations, all moreover contained within the scope of protection of the invention, as defined by the following claims.

What is claimed is:

1. A device (1) for the application and/or for the removal of elements for the connection of a rail to a railway track sleeper, comprising:

at least one lever (2,3) mounted on a frame (4) so as to be able to rotate around an axis of rotation (5,6) and equipped with at least one pressure organ (7,8) adapted to engaging the connecting element;

at least one cylinder-piston group (9) adapted to driving the lever (2,3) in order to assemble or disassemble the connecting element, said cylinder-piston group (9) comprising a cylinder body (10) connected to said frame (4) and a piston (11) slidingly housed within the cylinder body (10) and movable with respect to the cylinder body (10) under the action of pressurised fluid acting on said piston (11) inside said cylinder body (10), at least a first (12,14) and a second (13,15) stop surface cooperating in such a way as to form a stop device (16,17) for stopping the lever (2,3) in a defined position with respect to the frame (4), wherein said stop surfaces are formed, one (12,14) of them on the piston (11) and the other one (13,15) on the cylinder body (10) of said cylinder-piston group (9) such that, when said first stop surface (12,14) abuts against said second stop surface (13,15), said piston (11) stops in a limit position with respect to said cylinder body (10) and wherein said piston (11) is connected with said lever (2,3) in such a way that, when said piston (11) stops in said limit position, said lever (2,3) stops in said defined position with respect to the frame (4).

2. The device (1) according to claim 1, wherein said stop device (16,17) comprises adjusting means (18,23, 25) which allow the adjustment of the position of at least one of said first and second stop surfaces (12,14; 13, 15).

3. The device (1) according to claim 2, wherein said adjusting means comprise at least one adjusting ring nut (18,23) for the fine adjustment of the position of at least one stop surface (12,14; 13,15).

4. The device (1) according to claim 2, wherein said adjustment means comprise rapid changeover means (25) for the rapid displacement of one (12) of said stop surfaces and its positioning in at least two different positions.

5. The device (1) according to claim 1, wherein the cylinder-piston group (9) comprises two stop devices (16,17) defining a protracted limit position and a withdrawn limit position for the piston (11).

6. The device (1) according to claim 1, wherein a first stop device (16) comprises: -a stop member (25) connected to a first end (24) of the piston (11) and equipped with a first stop surface (12), -an adjusting ring nut (23) screwed onto the cylinder body (10) and carrying a second stop surface (13), wherein the stop surfaces (12,13) are configured in such a way as to abut against one another in a withdrawn position of the piston(11) thus impeding any further movement in a first direction, said withdrawn position being adjustable through the rotation of the adjusting ring nut (23).

7. The device (1) according to claim 6, wherein at the adjusting ring nut (23) is placed a graduated plate (26) integral with the cylinder body (10), which allows the precise positioning of the adjusting ring nut (23).

8. The device (1) according to claim 5, wherein the stop member (25) is moveable in a sliding manner along the piston (11) and positionable in at least two different changeover positions, providing said rapid changeover means between two withdrawn positions of the piston (11).

9. The device (1) according to claim 8, wherein the stop member (25) comprises a first support surface (31) and a second support surface (32) with different distances from the stop surfaces (12) and adapted to coming up against at least one bearing surface (33) of the piston (11).

10. The device (1) according to claim 9, wherein the stop member (25) comprises two first opposing grooves (34) and two second opposing grooves (35) out of phase by 90 with respect to the first grooves (34) and the bearing block (36) projecting radially from two opposite sides of the piston (11), such as to be able to engage respectively either the first two grooves (34) or the second two grooves (35).

11. The device (1) according to claim 8, comprising blocking means (38,39) for locking the stop member (25) in its changeover positions.

12. The device (1) according to claim 11, wherein said blocking means comprise a resilient stop dowel (38), adapted to engaging grooves (39).

13. The device (1) according to claim 8, wherein the bearing block (36) is formed in a separate stem (40), connectable by a first side to the piston (11) and by a second side to the lever (2,3).

14. The device (1) according to claim 9, wherein the stop member (25) delimits at least a first groove (34) which forms the first support surface (31) and a second groove (35), deeper than the first groove (34), which forms the second support surface (32), said grooves being adapted to engaging a bearing block (36) having said bearing surface (33).

15. The device (1) according to claim 1, wherein a second stop device (16) comprises:

a mushroom-shaped section (19) arranged at a second end (20) of the piston (11) and provided with a first stop surface (14); and an adjusting ring nut (18) screwed onto the cylinder body (10) and having a second stop surface (15), wherein the stop surfaces (14, 15) are configured in such a way as to abut against one another in a protracted position of the piston (11) thus impeding any further movement in a first direction, said protracted position being adjustable through the rotation of the adjusting ring nut (18).

16. The device (1) according to claim 15, wherein at the adjusting ring nut (18) is placed a graduated plate (22) integral with the cylinder body (10), which allows the precise positioning of the adjusting ring nut (18).

17. The device (1) according to claim 15, wherein a hollow cover (21) is fixed to the adjusting ring nut (18) and adapted to housing and protecting said second end (20) of the piston (11) with the mushroom-shaped section (19).

18. The device (1) according to claim 15, wherein the mushroom-shaped section (19) is formed by a screw, screwed into a hole in the second end (20) of the piston (11).

19. The device (1) according to claim 1, comprising two opposing levers (2,3), mounted on two sides of the frame (4) in a rotatable manner around the respective axes (5,6).

20. The device (1) according to claim 19, wherein the two levers (2,3) are movable through two cylinder-piston groups (9), one for each of the two levers (2,3).

21. The device (1) according to claim 19, comprising a single cylinder-piston group (9), connected to both levers (2,3).

22. The device (1) according to claim 1, wherein the cylinder body (10) is connected to the frame (4) and the piston (11) is connected to the corresponding lever (2,3).

23. The device (1) according to claim 1, wherein the pressure organs comprise a pressure shoulder (7) for the insertion, and a hook (8) for the extraction of the connecting element.

* * * * *